US009925995B1

(12) United States Patent
Schnell

(10) Patent No.: US 9,925,995 B1
(45) Date of Patent: Mar. 27, 2018

(54) HIGHWAY CROSSING OUT-OF-SERVICE CONTROLLER

(71) Applicant: BNSF Railway Company, Fort Worth, TX (US)

(72) Inventor: Joseph Daniel Schnell, Olathe, KS (US)

(73) Assignee: BNSF Railway Company, Fort Worth, TX (US)

( * ) Notice: Subject to any disclaimer, the term of this patent is extended or adjusted under 35 U.S.C. 154(b) by 428 days.

(21) Appl. No.: 14/612,336

(22) Filed: Feb. 3, 2015

(51) Int. Cl.
*B61L 29/30* (2006.01)
*B61L 29/32* (2006.01)
*B61L 29/28* (2006.01)

(52) U.S. Cl.
CPC ..... *B61L 29/30* (2013.01); *B61L 29/28* (2013.01); *B61L 29/32* (2013.01)

(58) Field of Classification Search
CPC ..... B61L 29/28; B61L 29/288; B61L 29/30; B61L 29/32
See application file for complete search history.

(56) References Cited

U.S. PATENT DOCUMENTS 3,734,434 A * 5/1973 Smith ..... B61L 29/288 246/125
3,927,852 A * 12/1975 Sibley ..... B61L 29/288 246/125
4,581,700 A * 4/1986 Farnham ..... B61L 29/226 246/121
6,113,037 A * 9/2000 Pace ..... B61L 23/06 246/124
2014/0191090 A1* 7/2014 Busse ..... B61L 29/284 246/126
2014/0361125 A1* 12/2014 Fries ..... B61L 29/04 246/473.1
2014/0367526 A1* 12/2014 Steffen, II ..... B61L 23/00 246/126
2016/0189552 A1* 6/2016 Hilleary ..... G08G 7/02 246/125
2017/0072975 A1* 3/2017 Martin ..... B61L 29/28

* cited by examiner

*Primary Examiner* — Zachary L Kuhfuss

(57) ABSTRACT

A system for selectively disabling highway crossing equipment includes a timer for controlling a maximum out of service time for the highway crossing equipment, a switch for controlling disablement of the highway crossing equipment, and control circuitry responsive to the timer and the switch. The control circuitry disables the highway crossing equipment in response to an input received from the switch before the maximum out of service time has been reached and re-enables the highway crossing equipment in response to a subsequent input from the switch received before the maximum out of service time has been reached. The control circuitry places the highway crossing equipment in a failsafe condition when the maximum out of service time has been reached without receiving the subsequent input from the switch.

20 Claims, 15 Drawing Sheets

HIGHWAY CROSSING OUT-OF-SERVICE CONTROLLER

FIELD OF INVENTION

The present invention relates in general to railroad operations, and in particular to a highway crossing out-of-service controller.

BACKGROUND OF INVENTION

In the railroad industry, a number of different monikers are used to refer to location where the tracks of a rail line cross a road or highway, including highway crossing, railway crossing, grade crossing, level crossing, and railway crossing, among others. For purposes of the present discussion, the term "highway crossing" will be used, although any of the terms commonly used in the railroad industry will apply equally well to the following discussion. Whatever the term used, highway crossings are familiar worldwide.

Highway crossings provide a significant hazard to vehicles and pedestrians on the intersecting highway or road, as well as to the trains and their crews, passengers, and cargo. In particular, a moving train cannot quickly stop or significantly reduce its speed in response to an obstacle on the track, such as a pedestrian or vehicle, given its mass. Hence, a ubiquitous strategy has developed over the many years in which the railroads have operated, namely, maintaining clear tracks in advance of oncoming trains.

Active highway crossings are very familiar, at least to those living in the United States. Generally, an electrical track circuit, which transmits either a DC or AC signal through a circuit formed by the pair of rails of the track itself, detects the wheels of a train entering the block or section of track on the approach to the highway crossing. Depending on the speed of the train and its distance from the crossing, an associated electrical control system then lowers crossing gates, activates flashing lights, and/or activates bells, depending on the particular system configuration. The control system is typically maintained within a housing or cabinet in the vicinity of the highway crossings.

Active crossing systems must occasionally be disabled, for example, for testing, maintenance, inspection, or repair or to allow work crews to repair or inspect the tracks adjacent the highway crossing without causing false or repeated activation of the gates, flashing lights, and/or bells. However, current techniques for disabling active crossing systems are complicated, and often involve placing physical jumpers across the correct terminals on the back of the electrical control system.

Another issue that has plagued the railroad industry since the inception of active crossings is railroad employees leaving a track/crossing out of service, releasing trains, and leaving the area. This leads to what is referred to by the Federal Railroad Administration ("FRA") as a "Human Caused Activation Failure", where a train traverses the crossing and the warning system does not activate because of human manipulation (e.g., railroad personnel took the active crossing system out of service). Such failures have resulted in serious accidents.

SUMMARY OF INVENTION

The principles of the present invention are embodied in a system for selectively disabling highway crossing equipment, which includes a timer for controlling a maximum out of service time, a switch for selectively disabling the highway crossing equipment, and control circuitry responsive to the timer and the switch. The control circuitry disables the highway crossing equipment in response to an input from the switch received before the maximum out of service time has been reached and re-enables the highway crossing equipment in response to a subsequent input from the switch received before the maximum out of service time has been reached. When the highway crossing equipment has been disabled, but no subsequent input from the switch is received before the maximum out of service time has been reached, the control circuitry places the highway crossing equipment in a failsafe condition.

Particular embodiments of the present principles provide a highway out-of-service controller, which includes a simple user interface, along with a diagram and lighted indicators, which clearly indicates the track being taken out of service. By having a diagram of the crossing with all the tracks labeled on the unit itself, the confusion of which track is being taken out of service is substantially reduced or eliminated.

Operationally, the embodiments of the present principles directly address the problem of Human Caused Activation Failures. A track can only be taken out of service once an internal timer is set. A railroad employee may set the timer for whatever amount of track and time (i.e., protection on the tracks) that was granted by the dispatch office. However, once the timer expires, if not all the tracks are restored to their normal working conditions, the highway out-of-service controller activates the crossing putting it to the safest position for the public (e.g., crossing gates are lowered, flashing lights and bells activated, and so on) until the employee returns, ensures the crossing is working properly, and restores the crossing system to its normal operational status by actively providing inputs into the system.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-5 of the drawings, in which like numbers designate like parts.

Figure 1A:
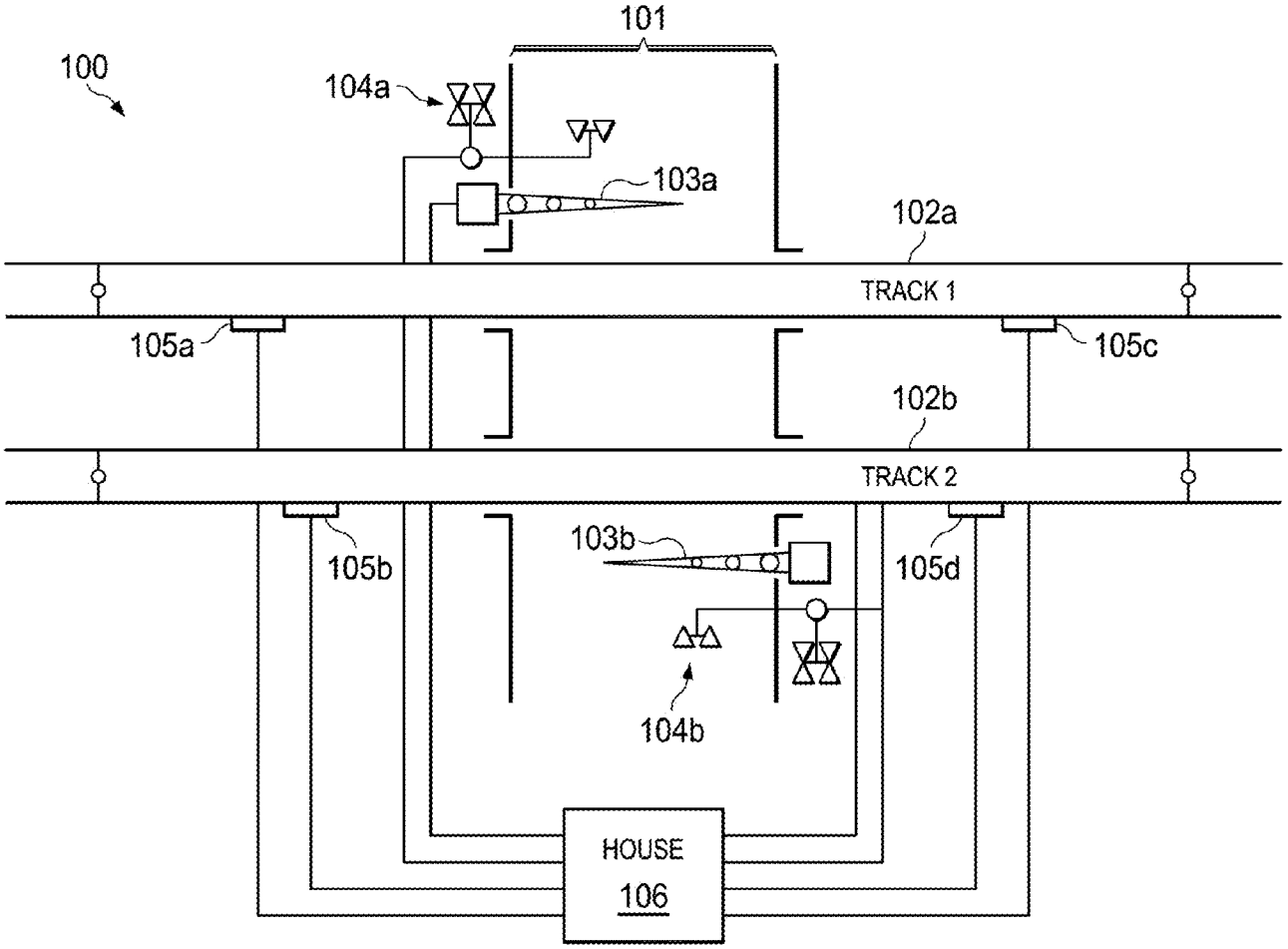
FIG. 1A is a diagram of a representative highway crossing, where two railroad tracks cross a roadway, suitable for describing a typical application of a highway crossing out-of-service controller (HCOOSC) embodying the principles of the present invention.

FIG. 1A is a diagram of an exemplary highway crossing 100 suitable for demonstrating a typical application of a highway crossing out-of-service controller (HCOOSC) 200 (FIG. 2A) embodying the principles of the present invention. As shown in FIG. 1A, a two-way highway or roadway 101 crosses a pair of parallel tracks 102*a* (track 1) and 102*b* (track 2). In actual practice, the number and direction of the lanes of roadway 101, as well as the number and/or orientation of tracks 102, may vary depending on the particular crossing site. In the typical application of HCOOSC 200, tracks 102 are either railroad or light railway tracks.

Highway crossing 100 is equipped with conventional crossing gates 103*a*-103*b* (including flashers), flasher systems 104*a*-104*b*, train motion detectors 105*a*-105*d*, and a housing 106 holding conventional highway crossing control systems such as a crossing controller, an event recorder, a cellular communications system, back-up batteries, and battery chargers. Audible warning component, such as bells, may also be provided. In the preferred embodiment, HCOOSC is also located within housing 106

Figure 1B:
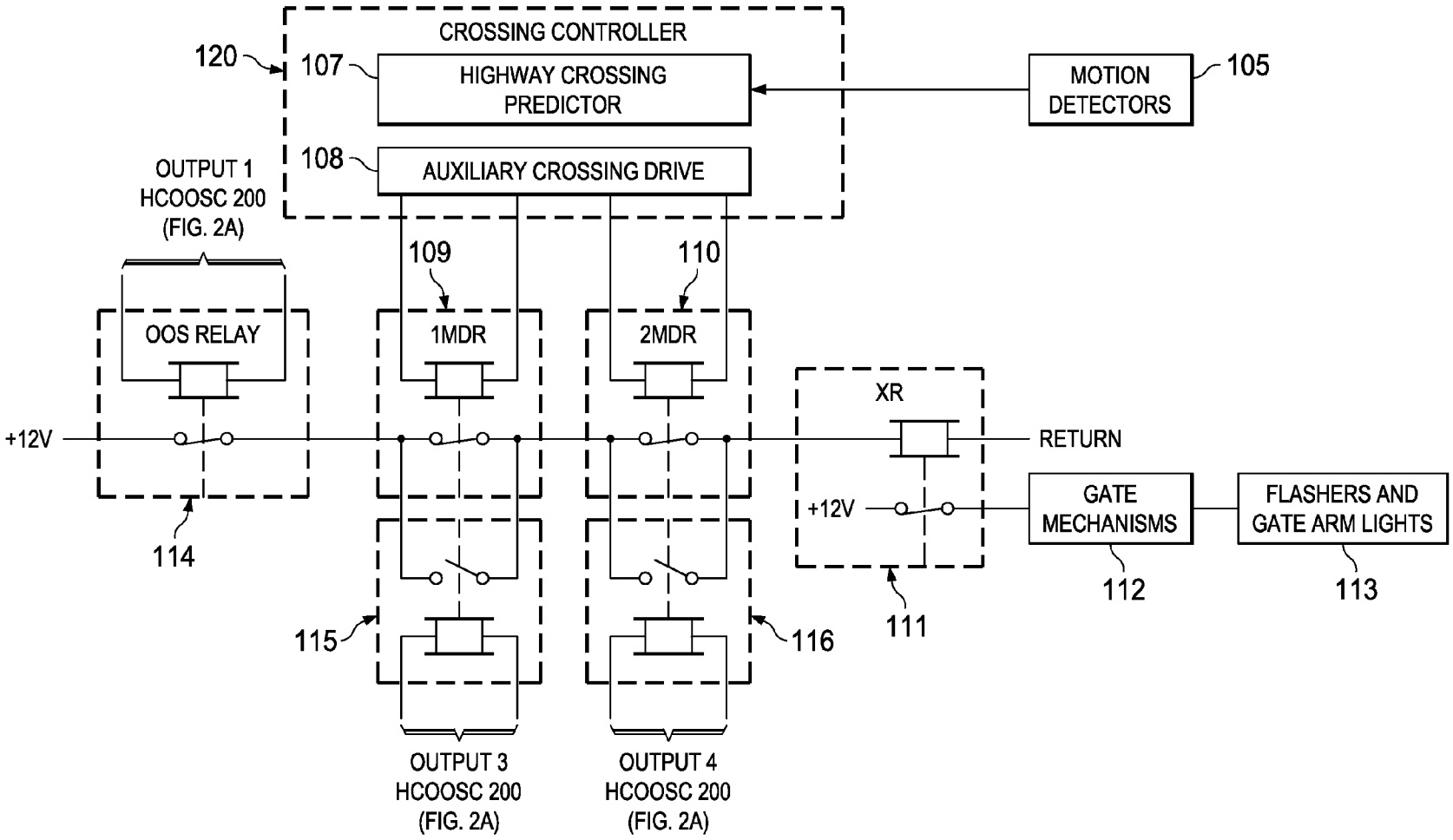
FIG. 1B is a high level diagram of the primary electrical system components of a representative highway crossing or control system suitable for describing a typical application of a highway crossing out-of-service controller according to a preferred embodiment of the principles of the present invention.

FIG. 1B illustrates particular components of a typical highway crossing control system, which controls the operation of crossing gates 103*a*-103*b* and flashers 104*a*-104*b*, among other things. In normal operation, motion detectors 105*a*-105*d* detect a train approaching highway way crossing 100 from a given direction on either Track 1 102*a* or Track 2 102*b*. The detection signals generated by the given motion detector 105 are processed by a highway crossing predictor 107 of highway crossing controller 120, which determines the time to activate crossing gates 103*a*-103*b* and flashers 104*a*-104*b* based on train speed.

At the activation time determined by highway crossing predictor 107, an auxiliary crossing drive 108 deactivates power to the coil of motion detection relay (1MDR), 109 for motion detected on Track 1, or track 2 motion detection relay (2MDR) 110, for motion detected on Track 2. With the coil of the given relay 109 or 110 deactivated, that relay opens ("drops"), which breaks the DC power path providing power to the coil of vital relay (XR) 111. In turn, XC 111 drops and breaks the DC power path to gate mechanisms 112 and flashers and gate arm light controllers 113. In response, gate mechanisms 112 and flashers and gate arm light controllers 113 activate crossing gates 103*a*-103*b* and flashers 104*a*-104*b*.

According to the principles of the present invention, three additional relays are added to the conventional highway crossing control system for ensure safe highway out-of-service operations under the control of HCOOSC 200. As will be discussed in detail below, out-of-service (00S) relay 114 breaks the DC power path to the coil XR 111, which places the highway crossing in the safest possible state for the public (i.e., crossing gates 103*a*-103*b* and flashers 104*a*-104*b* are activated). Bypass 115 relay, when closed, bypasses 1MDR 109, such that service vehicles operating on Track 1 do not trigger the activation of crossing gates 103*a*-103*b* and flashers 104*a*-104*b*. Similarly, bypass Relay 116, when closed, bypasses 2MDR 110, such that service vehicles operating on Track 2 do not trigger activation of crossing gates 103*a*-103*b* and flashers 104*a*-104*b*.

Figure 2A:
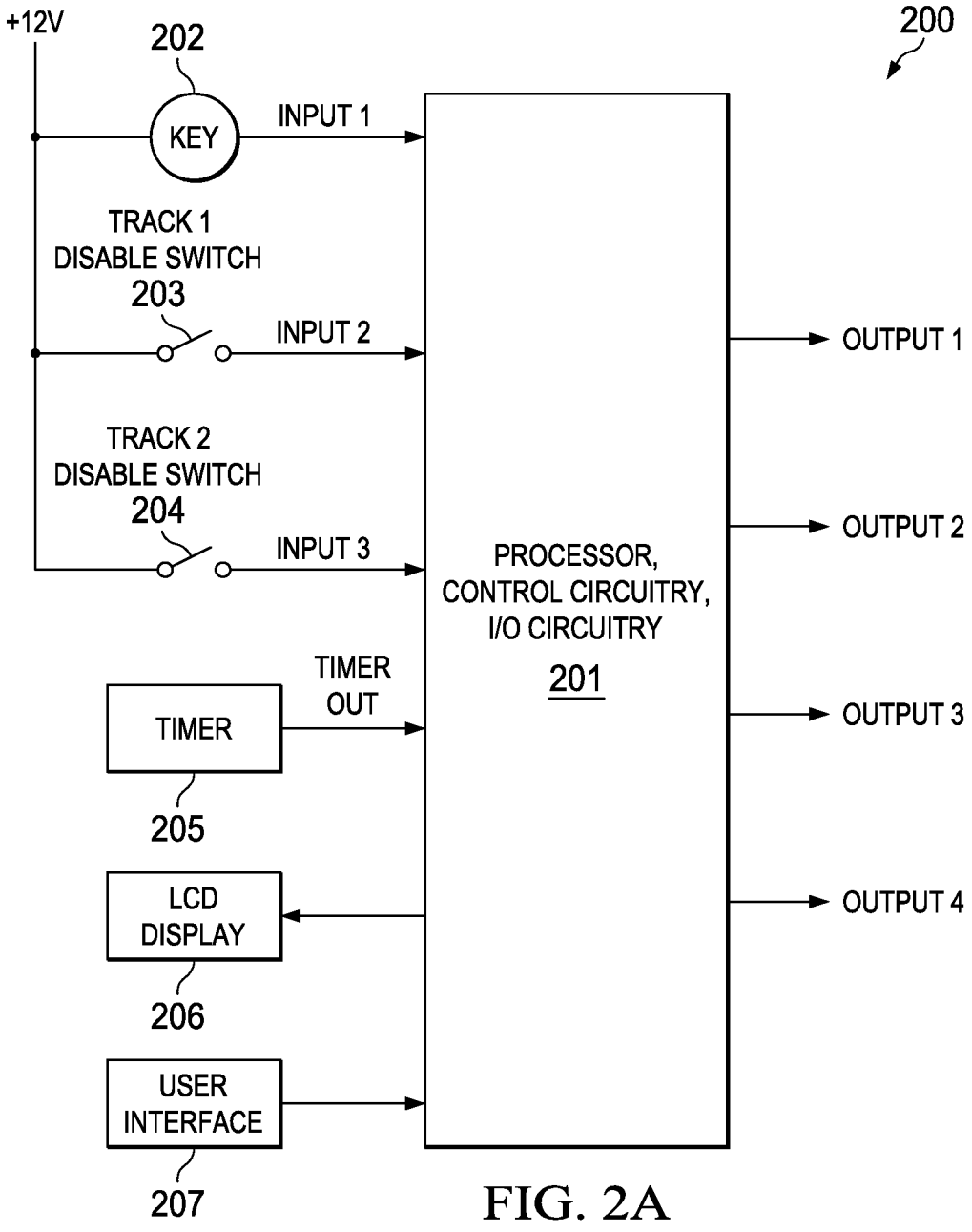
FIG. 2A is a high level electrical block diagram of the preferred embodiment of the highway crossing out-of-service controller.
Figure 2B:
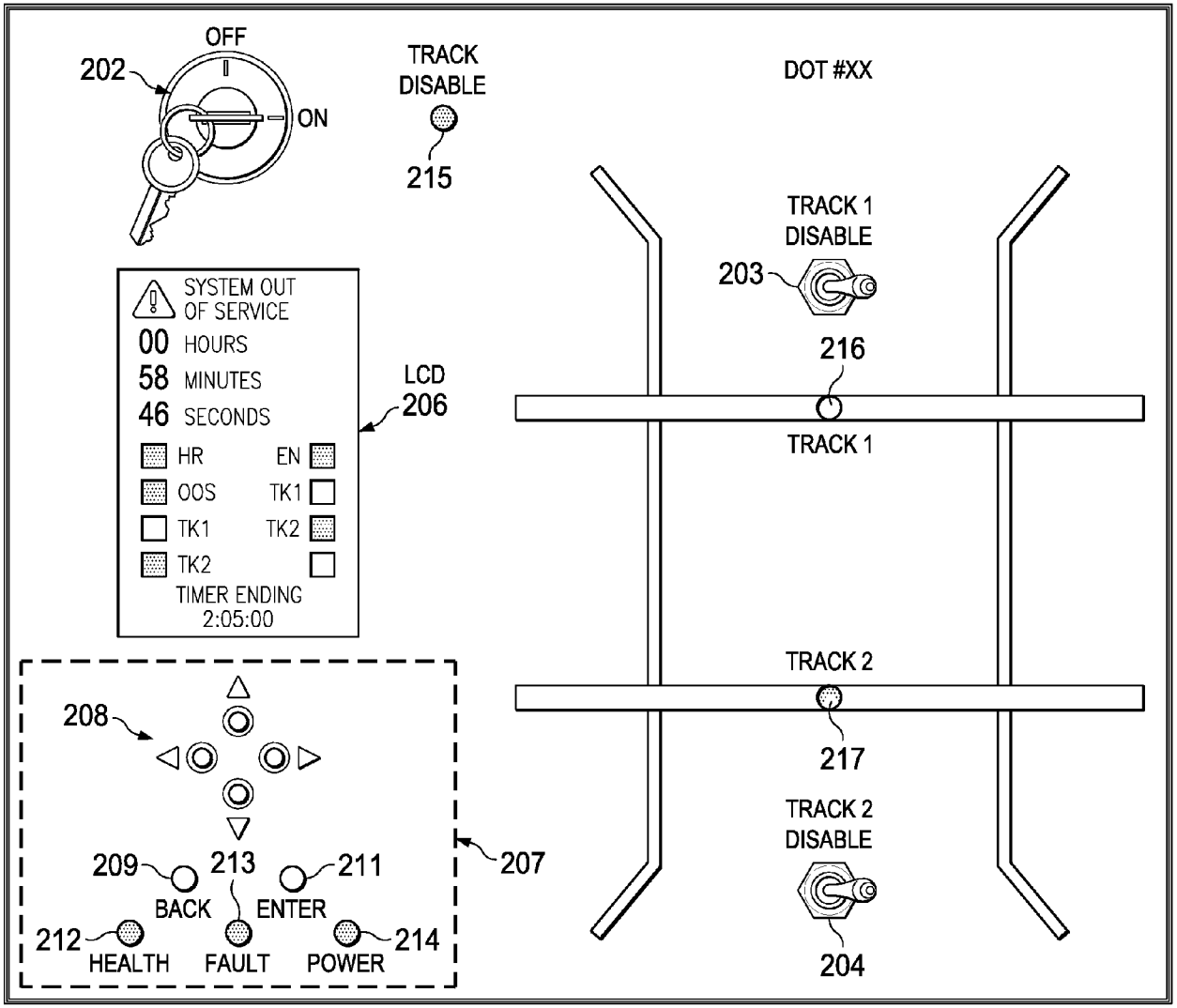
FIG. 2B is a diagram showing the front panel of the preferred embodiment of the highway crossing out-of-service controller.
Figure 3:
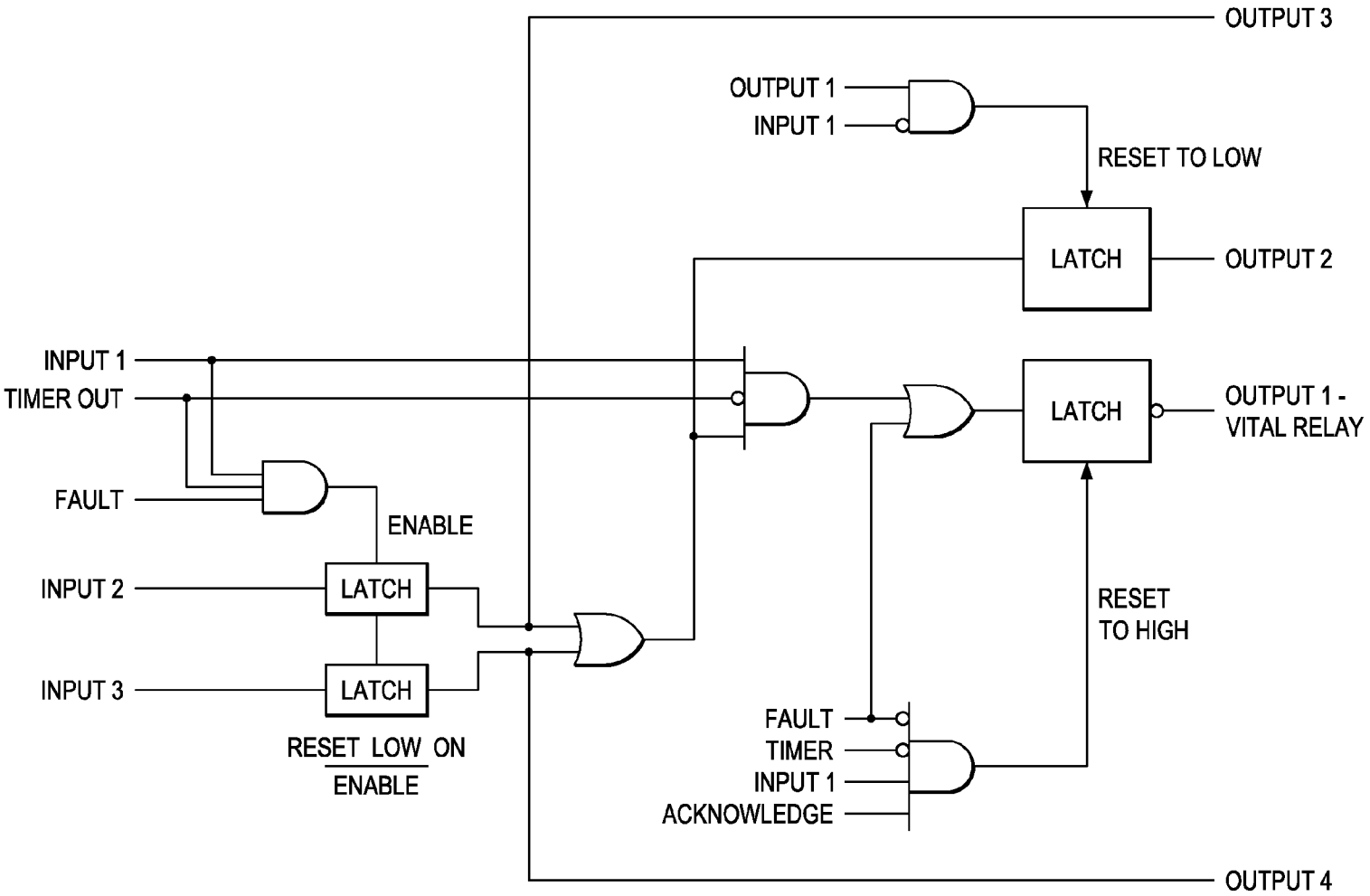
FIG. 3 is a logic diagram illustrating the operation of the preferred embodiment of the highway crossing out-of-service controller.

FIG. 2A is a high-level electrical functional block diagram of a preferred embodiment of HCOOSC 200. A preferred arrangement of the front panel of HCOOSC 200 is shown in FIG. 2B, although the front panel arrangement may vary in alternate embodiments. It should also be recognized that the voltages cited in the following discussion may also vary in alternate embodiments. The general operation of HCOOSC 200 for the preferred embodiment can be described in conjunction with the logic diagram of FIG. 3, although complementary logic may be used in alternate embodiments.

HCOOSC 200 is based on core processing circuitry 201 including a programmable microprocessor and associated memory, control circuitry, and input/output (I/O) circuitry. Processing circuitry 201 receives three switch-controlled inputs. Input 1 is a constant +12 V signal in the active state and is switched by key 202. Input 1 acts as the system enable signal and HCOOSC 200 will not operate until key 202 is in the on position and Input 1 is active. I Input 2 is a momentary +12 V input in the active state and toggles between the active high state and the low state (~0 V) in software every time Track 1 Disable switch 203 is toggled. Input 2 is latched when both Input 1 and the Timer Out signal from timer 205 is active. Input 3 is a momentary +12 V input in the active state and toggles between the active high state and the low state (~0 V) in software every time Track 2 Disable switch 204 is toggled. Input 3 is latched when both Input 1 and the Timer Out signal from timer 205 is active. (In other words, Inputs 2 and 3 are ignored until Input 1 is in an active high state and timer 205 is running.)

Timer 205 provides the Timer Out signal to processing circuitry 201 and controls the maximum length of time a track can be kept out of service before the highway crossing is automatically placed in its safest state for the public. (The time period set into timer 205 may be extended by input from railroad employees before the current time period expires. An out-of-service time period (or extension) is entered into timer 205 by authorized railroad personnel using LCD display 206 and user interface 207. In the preferred embodiment, the timer 205 output signal Timer Out remains in an active high state throughout the out-of-service time period and transitions to a low state when the out-of-service time period expires (i.e., timer 205 times out).

In the illustrated embodiment, LCD display 206 is capable of displaying additional information, such as the amount of time remaining (e.g., in hours, minutes, and seconds), the local time at which the timer will expire (e.g., the hour, minute, and second), and track status (e.g., operational or disabled). The type and amount of data displayed on LCD display 206 may vary between different embodiments of HCOOSC 200.

As shown in FIG. 2B, in the illustrated embodiment user interface 207 includes a set of buttons 208 for navigating through the information displayed on display 206, as well as a back button 209 and an enter button 211. In addition, LED 212 indicates system health, LED 213 indicates a fault condition, and LED 214 indicates power-on. The type and/or arrangement of the components of user interface 207 may also varying between embodiments of HCOOSC 200.

In the illustrated embodiment of FIG. 2B, a graphical representation of the highway crossing 100 is provided on the face plate of HCOOSC 200, along with Track 1 and Track 2 indicators 216 and 217 and Track Disable indicator 215. Indicators 215, 216, and 217 may be, for example, LEDs or lights. The use of the graphical representation and lighted indicators advantageously allow railroad personnel to quickly see the current state of highway crossing 100 and assists in making sure that the correct track is taken out of service.

Track Disable indicator 215, when lit, indicates that key 202 is in the on position and toggle switches 203 and 204 may be used to take either or both of Tracks 1 and 2 out of service. When lit, Track 1 indicator 216 indicates that switch 203 has been toggled and relay 115 (FIG. 1B) has been closed to bypass 1MDR 109 such that motion detection on Track 1 has been disabled (i.e., taken out of service). Similarly, when lit, Track 2 indicator 217 indicates that switch 204 has been toggled and relay 116 (FIG. 1B) has been closed to bypass 2MDR 110 such that motion detection on Track 2 has been disabled (i.e., taken out of service). (FIG. 2B illustrates the case in which track 2 has been disabled.)

When enabled by key 202 and Input 1, HCOOSC 200 generates output signals Output 1-Output 4. (FIG. 2A). Output 1 acts as the vital relay control and is a normally high +12 V signal, which holds both OOS relay 114 and XR 111 in a closed state if at least one of track 1 102*a* or track 2 102*b* has been taken out of service and the maximum out-of-service time has not expired. In other words, Output 1 remains in the normal high state one or both of Input 2 and Input 3 have been set by switches 203 and 204 and latched high and Timer Out from timer 205 is active high.

In addition, Output 1 remains in the high state without transitioning low if the system is active (Input 1 is active high), at least one of tracks 102*a*-102*b* has been taken out of service (Input 2 and/or Input 3 has been latched active high), and the out-of-service time period entered into timer 205 is reset to a new time before timer 205 times out. Furthermore, if HCOOSC 200 is enabled, and Input 1 is then switched by key 202 to an inactive low state while at least one of tracks 102*a*-102*b* has been taken out of service (Input 2 and/or Input 3 has been latched active high) and Timer Out is still active high (the out-of-service time period has not expired), then timer 205 returns to a rest state and Output 1 remains in the normally high state.

Output 1 goes to a low (~0 V) state and opens OOS relay 114 and XR 111, thereby activating crossing gates 103*a*-103*b* and flashers 104*a*-104*b*, if at least one of tracks 1 102*a* and track 2 102*b* has been taken out of service and railroad personnel have failed to return that track to an operational state using track disable switches 203 and 204 before the expiration of the out-of-service time period. In other words, if either or both of Input 2 and Input 3 has been set by switches 203 and 204 and latched high and the Timer Out signal from timer 205 has transitioned to the low state, Output 1 will go low. Output 1 will also go low in the event of a fault condition within HCOOSC 200.

Once Output 1 has gone low, it will only return to the normally high state if there are no faults, the Timer Out signal from timer 205 is in the low state, Input 1 is in the active high state, and railroad personnel have entered an acknowledgement into user interface 207.

In the illustrated embodiment, Output 2 is used for monitoring and/or event recording purposes. Output 2 is normally low and transitions to a high state (+12 V) when at least one of Input 2 and Input 3 has been set by switches 203 and 204 and latched high to take the corresponding track 102*a*-102*b* out of service. Output 2 is reset to the normally low state when Output 1 is in its normal active high state and the enable signal of Input 1 has been switched back to the low state.

Output 3 in the active high state (+12 V) opens relay 115, which bypasses 1MDR 109 (FIG. 1B). Output 3 transitions to the active state when Input 2 has been latched high by the active high state of the Timer Out signal from timer 205.

Output 4 in the active high state (+12 V) opens relay 116, which bypasses 2MDR 110 (FIG. 1B). Output 4 transitions to the active state when Input 3 has been latched high by the active high state of the Timer Out signal from timer 205.

Figure 4A:
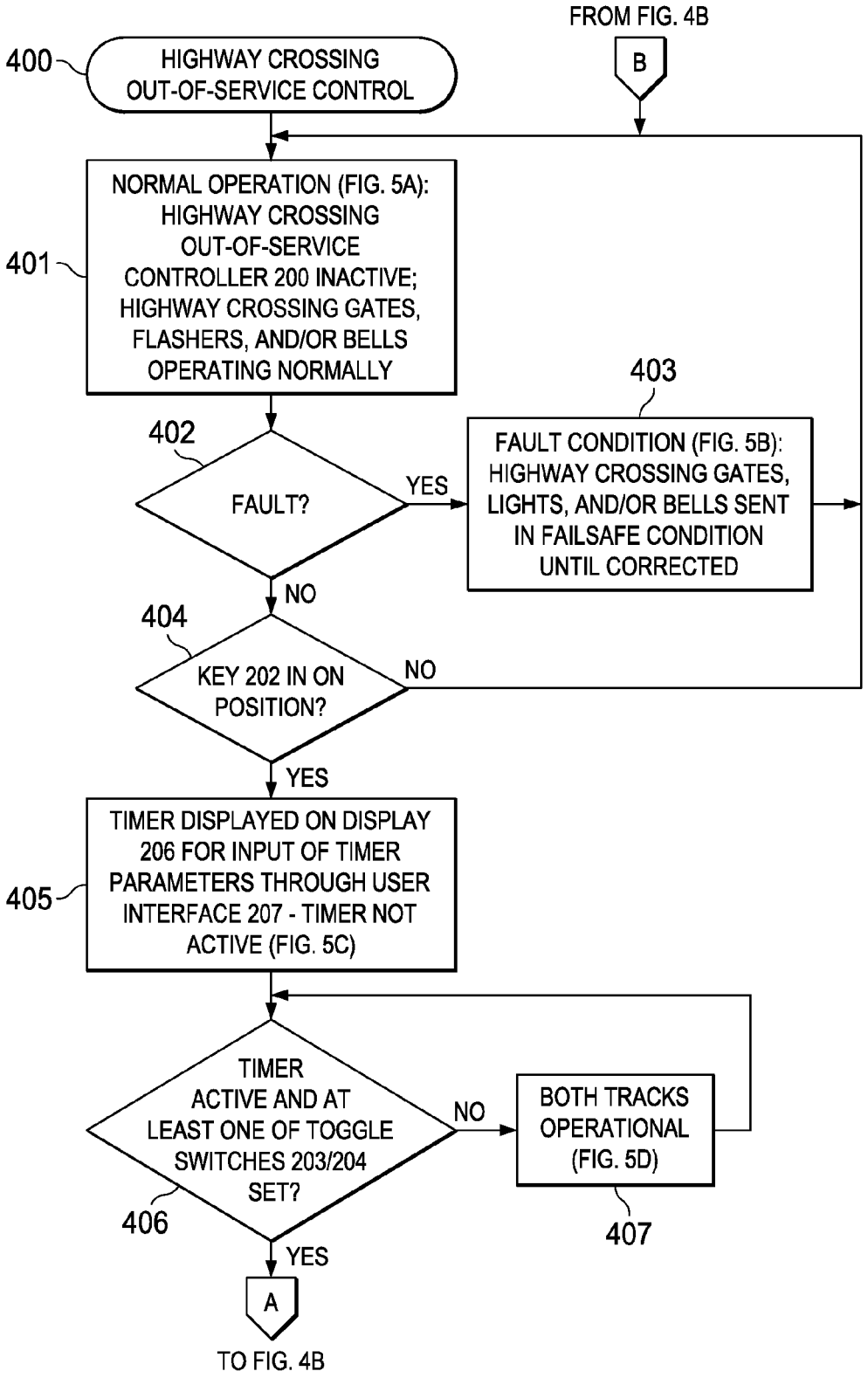
FIGS. 4A and 4B are a flow chart illustrating the operation of the preferred embodiment of the highway crossing out-of-service controller.
Figure 4B:
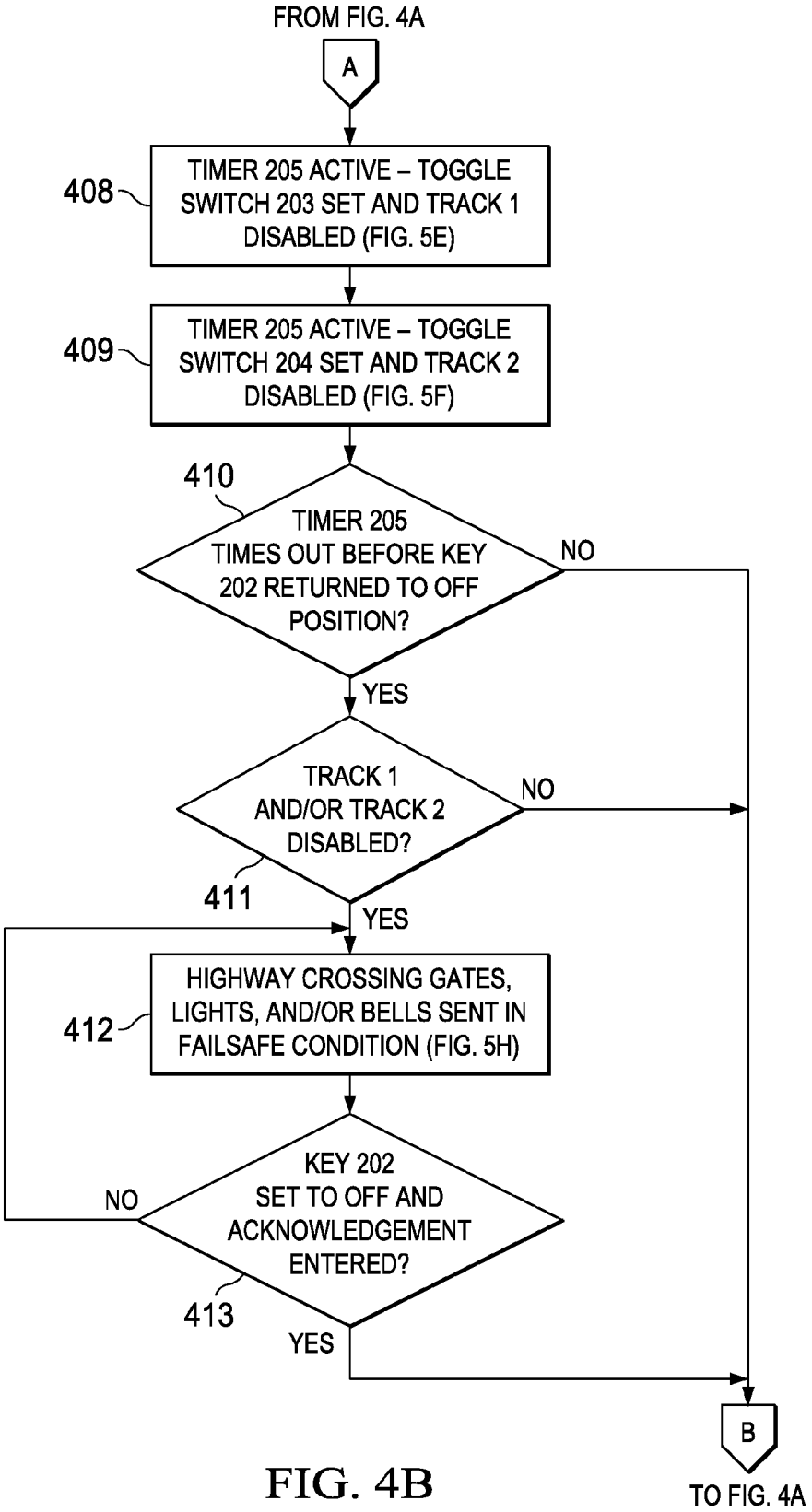

The operation of HCOOSC 200 can now be described with reference to the flow chart of FIGS. 4A and 4B and the timing diagrams of FIGS. 5A-5H. FIGS. 4A and 4B generally show a highway crossing out-of-service control procedure 400 according to the preferred embodiment of the present inventive principles. The timing diagrams of FIGS. 5A-5H are based on preferred input and output signals described above and the logic diagram of FIG. 3.

Figure 5A:
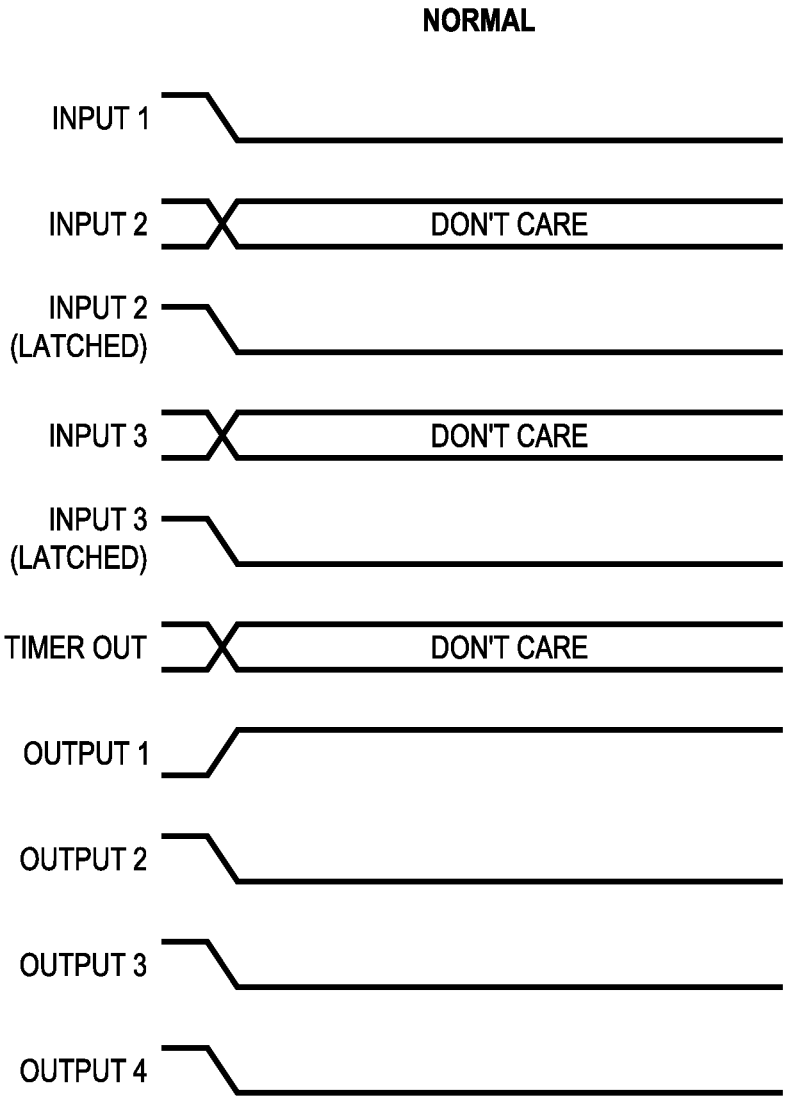
FIGS. 5A-5H are a series of timing diagrams illustrating the operation of the preferred embodiment of the highway crossing out-of-service controller.

At Block 401, highway crossing 100 is operating under normal conditions, with highway crossing gates 103*a*-103*b* and flashers 104*a*-104*b* operating in response to the detection of approaching trains by motion detectors 105*a*-105*d*. HCOOSC 200 is inactive with switch 202 switched to the off position. FIG. 5A illustrates the HCOOSC input and output signals under highway crossing 100 normal operating conditions. Input 1 is in a low inactive state, while Inputs 2 and 3 generated by any toggling of switches 203 and 204 are ignored. Output 1 remains in a high state to hold closed OOS relay 114, while Outputs 2, 3, and 4 remain in an inactive low state.

Figure 5B:
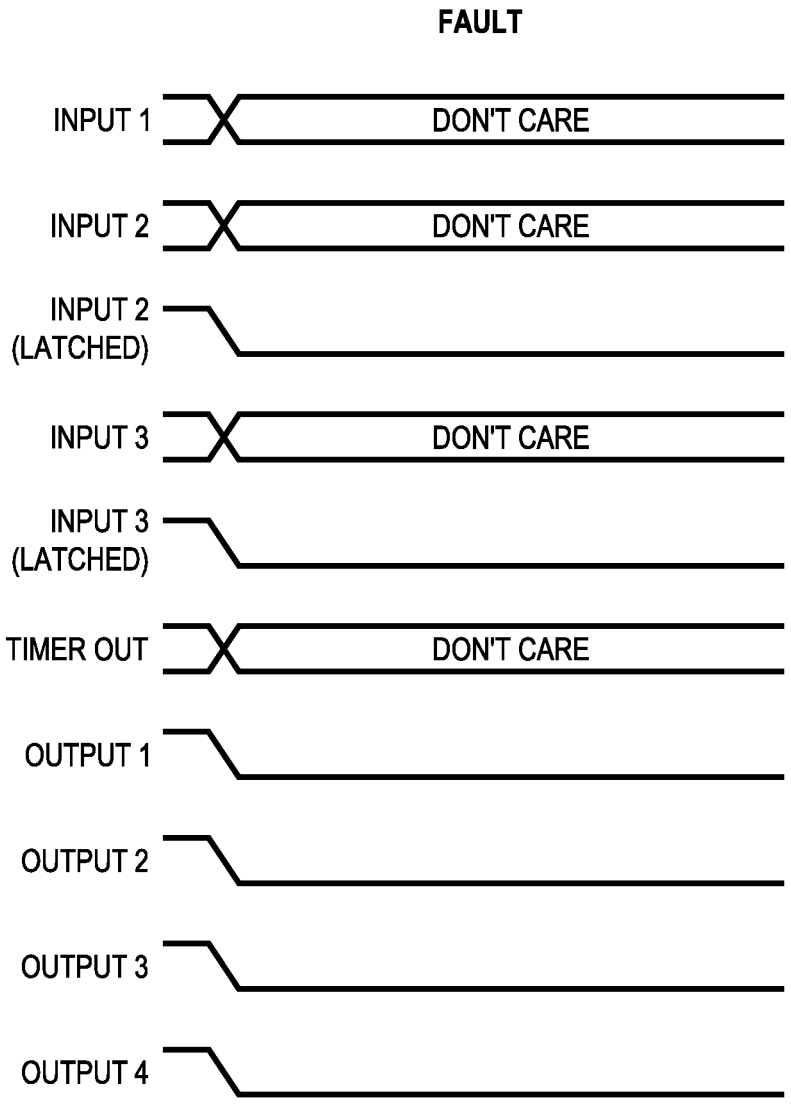

If at any time during procedure 400 a fault is detected in HCOOSC 200, at Decision Block 402, then at Block 403 highway crossing 100 is placed in the safest state for the public, preferably with highway crossing gates 103*a*-103*b* in the down position and flashers 104*a*-104*b* active, until the fault is corrected. The HCOOSC input and output signals under a fault condition are shown in FIG. 5B. In particular, Output 1 transitions to a low state to open OOS relay 114 and XR 111 and place highway crossing 100 in the failsafe state.

Figure 5C:
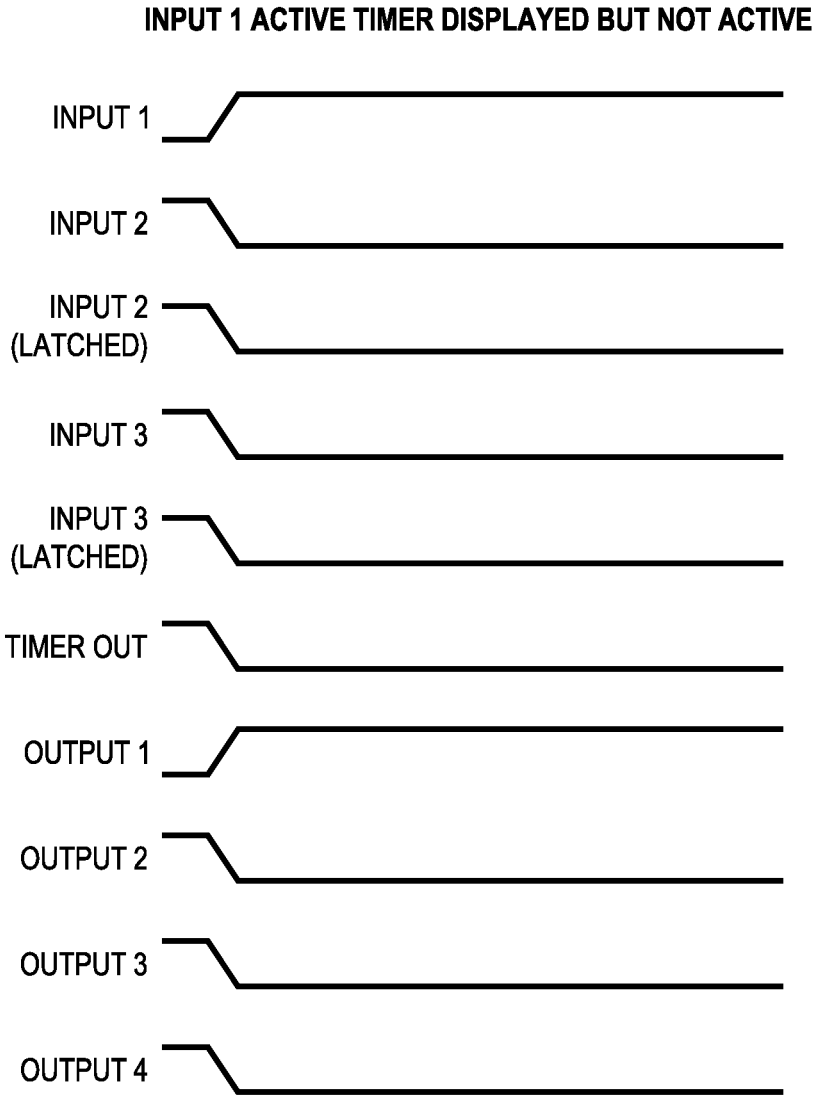

Otherwise, HCOOSC 200 remains in a wait state at Decision Block 504, until key 202 is turned to the on position and the Input 1 signal transitions to the active state. When Input 1 is active, Block 505, a timer is displayed on display 206 and allows for the input timer parameters, including the desired out-of-service time period, through user interface 207. For the preferred embodiment, the HCOOSC input and output signals are shown in FIG. 5C for the time period in which timer 207 is displayed but is not active.

Figure 5D:
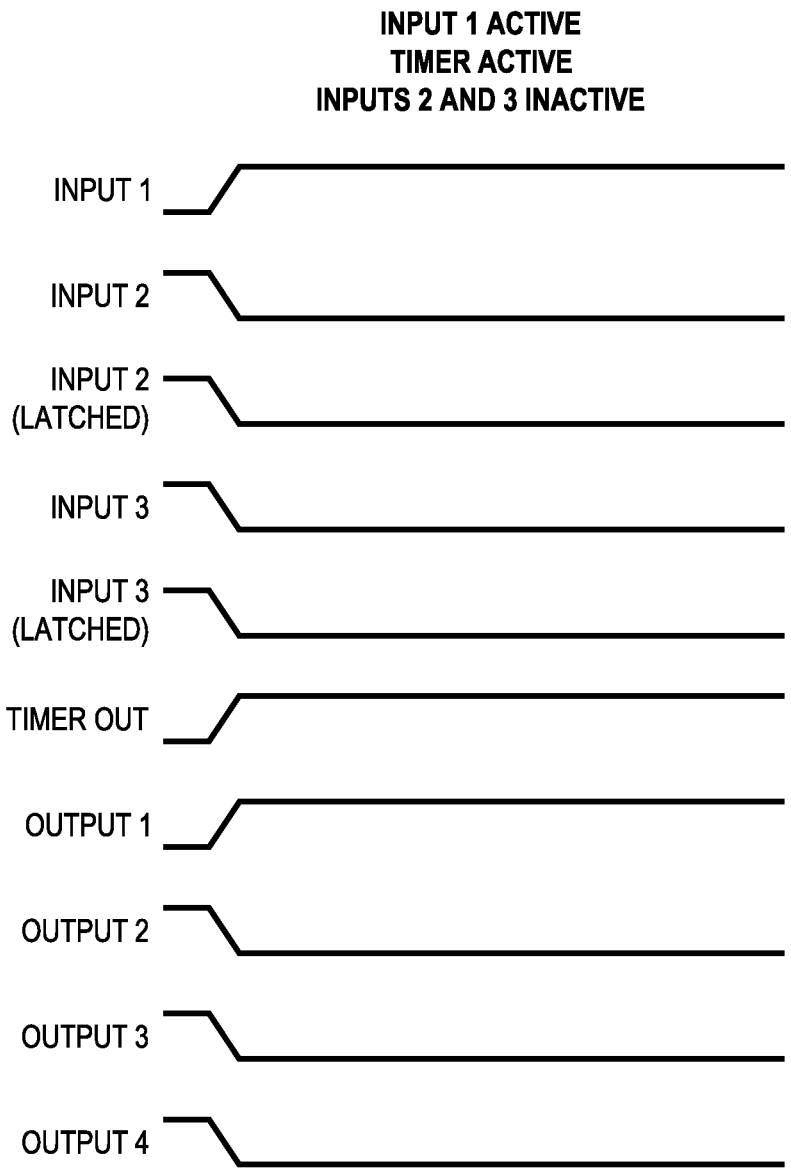

At Decision Block 506, timer 205 has been activated and begins to count down awaiting for either or both of switches 203 and 204 to be toggled. Until one of switches 203 and 204 has been toggled, both tracks 102*a*-102*b* remain active during the wait state at Block 407. The input and output signal states for the preferred embodiment of HCOOSC 200 are shown in FIG. 5D, where the signal Timer Out has now transitioned into an active high state, but Inputs 2 and 3, and consequently Outputs 3 and 4, remain in a low state.

If the timer 205 expires (i.e., Timer Out transitions to in the inactive low state) without either of switches 203 and 204 being toggled (i.e., Inputs 1 and 2 never transition into an active high state), then HCOOSC 200 locks. In the locked state, Output 1 remains in the normal high state and Outputs 2, 3, and 4 remain in the inactive low state. The Timer Out signal and Inputs 2 and 3 are ignored. In the preferred embodiment, LCD display 206 displays a message "System Locked, Remove Key". To reset HCOOSC 200, key 202 must be switched to the off position, which causes Input 1 to transition to the inactive low state returning HCOOSC 200 to the inactive state.

If switch 203 is toggled while the Timer Out signal is in the active high state (Block 508), Track 1 102*a* is disabled. As shown in the timing diagram of FIG. 5E, Input 1 is latched in the active high state, which causes Output 2 and Output 3 to transition to an active high state. In the high state, Output 3 closes bypass relay 115 (FIG. 1B) and 1MDR 109 is bypassed, allowing railroad personnel to work on Track 1 without triggering crossing gates 103*a*-103*b* and flashers 104*a*-104*b*.

If switch 204 is toggled while the Timer Out signal is in the active high state (Block 509), Track 2 102*b* is disabled. This state is shown for the preferred embodiment in FIG. 5F, where Input 2 is latched in the active high state, which causes Output 2 and Output 4 to transition to an active high state. In the high state, Output 4 closes bypass relay 116 (FIG. 1B) and 2MDR 116 is bypassed, allowing railroad personnel to work on Track 2 without triggering crossing gates 103*a*-103*b* and flashers 104*a*-104*b*.

Figure 5E:
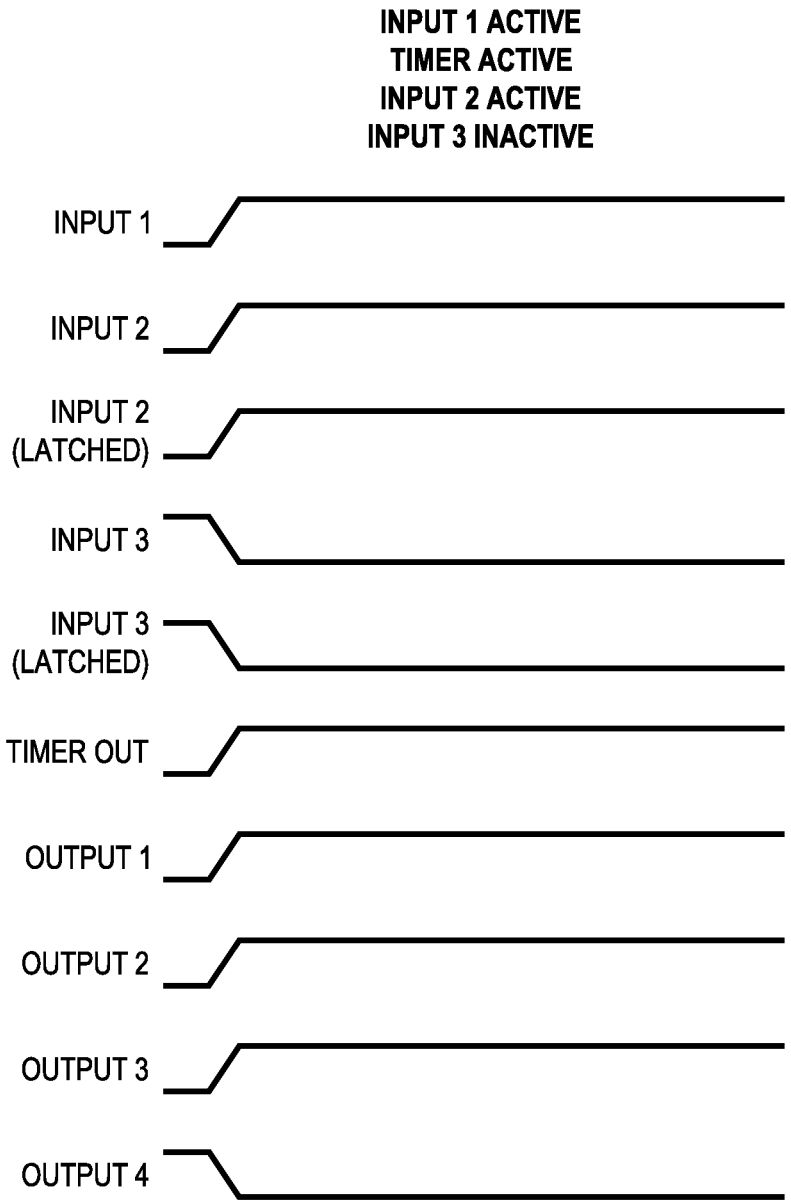
Figure 5F:
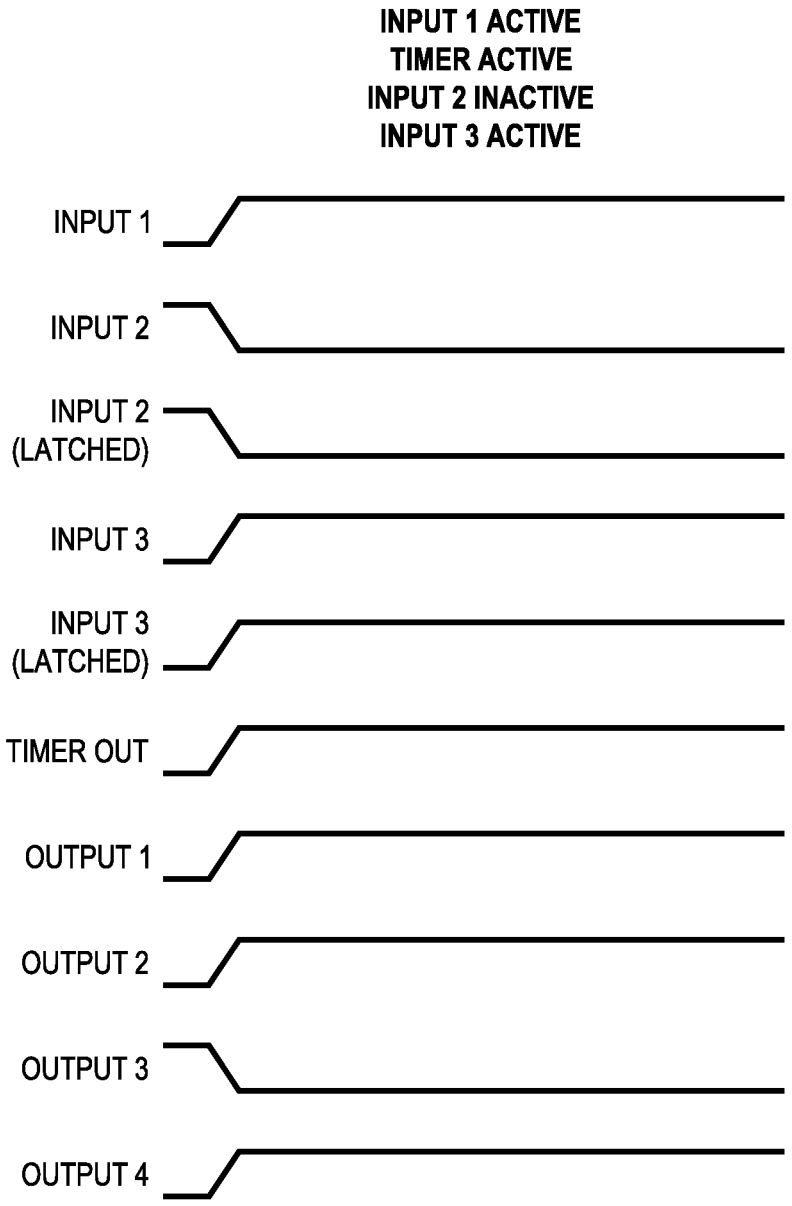

Both switches 203 and 204 may be toggled during the period when timer 207 output signal Time Out is active, in which case both Track 1 102*a* and Track 2 102 are disabled. When both Track 1 and Track 2 are disabled, Inputs 2 and 3 are latched in the logic high state and Outputs 3 and 4 transition to an active high state, as shown in FIGS. 5E and 5F, respectfully. With both Outputs 3 and 4 in the active high state, bypass relays 115 and 116 are both closed and both 1MDR 109 and 2 MDR 110 are bypassed.

With either Track 1 102*a* or Track 2 102*b* disabled during the period when the timer 207 output signal Timer Out is active high, LCD 206 displays a time count down, along with an option to extend the track out-of-service time. Railroad personnel may then extend the track out-of-service by a desired amount using user interface 207. Outputs 1-4 outputs will remain in their current states during this time.

Figure 5G:
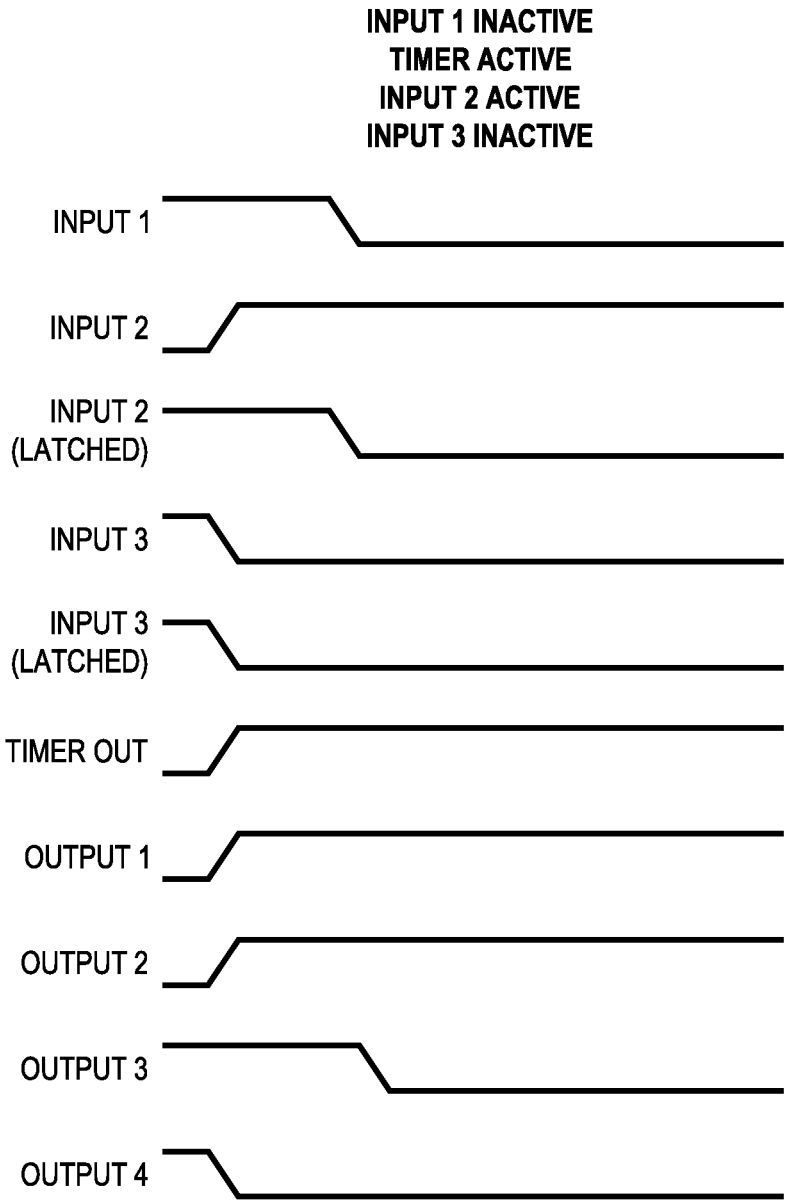

If at Decision Block 410 key 202 is switched to the off position before timer 207 has timed-out, then Input 1 transitions to the inactive low state, HCOOSC 200 returns to the inactive state at Block 401, and highway crossing 100 returns to normal operating conditions. FIG. 5G illustrates the case where switch 202 causes Input 1 to transition to an inactive low state while timer 207 signal Timer Out is active and Input 2 is active (Track 1 disabled). Output 1 remains in the normal high state and Outputs 2, 3, and 4 all transition to the low inactive state. The case where track 2 102*b* is disabled at timer 205 time out is similar.

Figure 5H:
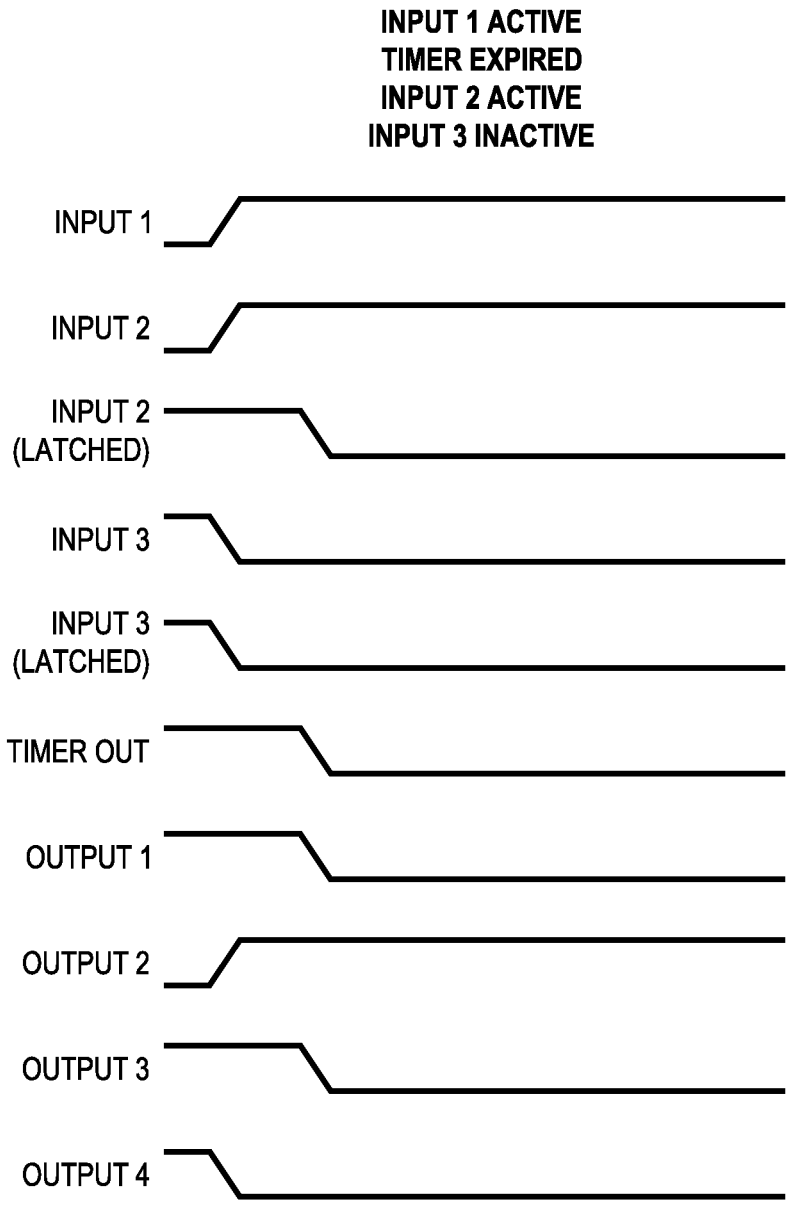

At Block 411, if either or both of Track 1 102*a* and Track 2 102*b* remain disabled when timer 205 times out, with the Input 1 in the active high state, Output 1 is forced into a low state (Block 412). With Output 1 in the low state, OOS relay 114 opens, which causes XR 111 to also open and send highway crossing 100 in the safest possible state for the public (e.g., with crossing gates 103*a*-103*b* and flashers 104*a*-104*b* activated). FIG. 5H illustrates the case where Track 1 102*a* remains disabled at time out, where Input 2 is high at the time timer 205 output 205 transitions low and Output 1 is forced to a low state.

In the preferred embodiment, when Output 1 transitions low a message such as "Timer Expiration Acknowledgement" is displayed on LCD 206. Output 1 remains in the low state (Decision Block 413) until key 202 is set to the off condition and railroad personnel enter an acknowledgment into HCOOSC 200 using user interface 207.

On the other hand, if at Decision Block 411 neither track 1 nor track 2 is disabled then highway crossing, 100 returns to normal operating conditions, with Output 1 remaining high.

The embodiments of the present inventive principles realize substantial advantages over the prior art. Among other things, a simple user interface is provided, along with a graphical depiction of the highway crossing and lighted indicators on the system front panel, which reduces railroad employee workload and minimizes the chance that the wrong track is taken out of service. Furthermore, a timer, which must be set to a maximum out of service time period before any tracks can be taken out of service, minimizes the chance that railroad employees will leave the highway crossing with the highway crossing gates and flashers disabled.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A system for selectively disabling highway crossing equipment comprising:

a user-programmable timer for controlling a maximum out of service time for the highway crossing equipment;

a user-actuated system enable switch;

a user-actuated equipment disable switch for selectively disabling the highway crossing equipment; and control circuitry responsive to the timer and the switch and operable to:

while the system enable switch is in a system enable state, disable the highway crossing equipment in response to an input from the equipment disable switch received before the maximum out of service time has been reached;

while the system enable switch is in a system enable state, re-enable the highway crossing equipment in response to a subsequent input received from the equipment disable switch before the maximum out of service time has been reached; and while the system enable switch is in a system enable state, place the highway crossing equipment in a failsafe condition when the maximum out of service time has been reached without receiving the subsequent input from the equipment disable switch.

2. The system of claim 1, wherein the control circuitry is further operable to:

re-enable the highway crossing equipment when the system enable switch is reset before the maximum out of service time has been reached.

3. The system of claim 1, wherein the control circuitry is operable to bypass motion detection equipment to disable the highway crossing equipment.

4. The system of claim 3, wherein the equipment disable switch comprises one of a plurality of equipment disable switches each for selectively bypassing motion detection equipment associated with a corresponding railroad track to disable the highway crossing equipment.

5. The system of claim 1, further comprising:

a user interface for allowing a user to program the maximum out of service time into the timer; and a display for displaying the maximum out of service time into the timer.

6. A railroad crossing out-of-service control system comprising: an enable switch for generating an enable signal;

a disable switch for generating a disable signal for selectively disabling highway crossing equipment associated with a railroad track;

a timer for generating a timer signal for controlling an out of service time; and control circuitry operable to:

generate at least one output signal for disabling the highway crossing equipment in response to a transition of the disable signal to an active state while the enable and timer signals are in an active state;

generate at least one output signal for re-enabling the highway crossing equipment in response to a selected one of:

a transition of the enable signal to an inactive state while the timer signal in the active state; and a transition of the disable signal to an inactive state while the enable and timer signals are in the active state; and generate at least one output signal for placing the highway crossing equipment in a safe condition in response to a transition of the timer signal to an inactive state while the enable and disable signals are in the active state.

7. The railroad crossing out-of-service control system of claim 6, wherein the control circuitry is operable to generate an output signal for selectively bypassing motion detection equipment controlling the highway crossing equipment to selectively disable and re-enable the highway crossing equipment.

8. The railroad crossing out-of-service control system of claim 6, wherein the control circuitry is operable to generate an output signal controlling a vital relay for placing the highway crossing equipment in a safe condition.

9. The railroad crossing out-of-service control system of claim 6, wherein the timer is programmable.

10. The railroad crossing out-of-service control system of claim 9, further comprising a user interface including a display and input circuitry for programming the timer.

11. The railroad crossing out-of-service control system of claim 6, wherein the control circuitry comprises a programmable processing device.

12. The railroad crossing out-of-service control system of claim 6, wherein the control circuitry comprises logic circuitry.

13. The railroad crossing out-of-service control system of claim 6, wherein the disable switch comprises one of a plurality of disable switches each for selectively generating a disable signal for disabling highway crossing equipment associated with a corresponding one of a plurality of railroad tracks.

14. The railroad crossing out-of-service control system of claim 6, wherein the highway crossing equipment is selected from the group consisting of flashers and crossing gates.

15. A railroad highway crossing system comprising;

a crossing relay selectively opening to activate associated highway crossing equipment and closing to deactivate the highway crossing equipment;

a motion detection relay selectively opening to open the crossing relay and closing to close the crossing relay;

a bypass relay selectively closing to bypass the motion relay and hold the crossing relay in a closed state;

a out-of-service relay selectively opening to open the crossing relay when the bypass relay is closed and closing with the bypass relay is closed to maintain the crossing relay closed;

an out-of-service controller operable to:

in response to a first user input during a programmed out-of-service time period, close the bypass relay to bypass the motion detection relay and maintain the out-of-service relay in a closed state to hold the crossing relay closed;

in response to a second subsequent user input during the programmed out-of-service time period, open the bypass relay and maintain the out-of-service relay in a closed state; and in response to the first user input without the subsequent second user input during the programmed out-of-service time period, open the out-of-service relay to open the crossing relay and activate the highway crossing equipment.

16. The railroad highway crossing system of claim 15, wherein the first user input comprises switching an enable switch and switching a track disable switch.

17. The railroad highway crossing system of claim 15, wherein the second user input comprises a selected one of switching the enable switch and switching the track disable switch.

18. The railroad highway crossing system of claim 15, wherein the out-of-service controller comprises a programmable timer for controlling the out-of-service time.

19. The railroad highway crossing system of claim 15, wherein the motion detection relay comprises a selected one of a plurality of motion detection relays each associated with a corresponding track and the bypass relay comprises a selected one of a plurality of bypass relays each for selectively bypassing a corresponding one of the motion detection relays.

20. The railroad highway crossing system of claim 15, further comprising a highway crossing controller controlling the motion detection relay.

* * * * *